US006302324B1

(12) United States Patent
Buchko

(10) Patent No.: US 6,302,324 B1
(45) Date of Patent: Oct. 16, 2001

(54) TRAY-TYPE RECEPTACLE FOR USE IN A PACKAGING METHOD FOR PERISHABLE FOOD PRODUCTS

(75) Inventor: Raymond G. Buchko, Appleton, WI (US)

(73) Assignee: Freshpak Development LLC, Appleton, WI (US)

( * ) Notice: Subject to any disclaimer, the term of this patent is extended or adjusted under 35 U.S.C. 154(b) by 0 days.

(21) Appl. No.: 09/382,854

(22) Filed: Aug. 25, 1999

Related U.S. Application Data

(62) Division of application No. 08/782,775, filed on Jan. 13, 1997, now Pat. No. 5,989,613.

(51) Int. Cl.[7] ..... B65B 31/02; B65D 1/34; B65D 1/40

(52) U.S. Cl. ..... 229/406; 220/359.1; 229/125.35; 229/407

(58) Field of Search ..... 229/125.35, 406, 229/407; 426/118, 129; 220/359.1; 53/432–434, 503, 508, 510–512

(56) References Cited

U.S. PATENT DOCUMENTS

| | | |
|---|---|---|
| 2,361,344 | 10/1944 | Yates . |
| 2,387,812 | 10/1945 | Sonneborn et al. . |
| 2,542,206 | 2/1951 | Nichols . |
| 2,863,267 | 12/1958 | Moore . |
| 3,360,382 | 12/1967 | Miller . |
| 3,407,078 | 10/1968 | Schlichter . |
| 3,490,576 | 1/1970 | Alessi et al. . |

(List continued on next page.)

FOREIGN PATENT DOCUMENTS

| | | |
|---|---|---|
| 1408217 | 7/1965 | (FR) . |
| 52-591 | 1/1977 | (JP) . |
| 54-148690 | 11/1979 | (JP) . |
| 03240615 | 10/1991 | (JP) . |
| 4-242572 | 8/1992 | (JP) . |
| 0597097 | 5/1994 | (JP) . |

*Primary Examiner*—Gary E. Elkins
(74) *Attorney, Agent, or Firm*—Boyle, Frederickson, Newholm, Stein & Gratz, S.C.

(57) ABSTRACT

A system for packaging of perishable food products involves initially packaging the food product in a receptacle containing an inert gas atmosphere and sealing a film to the receptacle. The inert gas atmosphere prevents deterioration of the food product subsequent to shipment from a central processing facility. The receptacle includes a sealing flange and a tab portion extending from the sealing flange, to which the film is sealed. To prepare the food product for display at a retail establishment, the tab and the film sealed thereto are removed from the package, to form an opening between the film and the receptacle. An atmosphere exchange operation is carried out through the opening, by inserting a nozzle through the opening and introducing an oxygen-containing gas into the receptacle cavity through the opening. The inert gas atmosphere initially contained within the receptacle is exhausted through the opening. Once the atmosphere exchange process has been carried out, the nozzle is withdrawn from the opening and the opening is closed by sealing the film to the receptacle. Introduction of the oxygen-containing gas into the receptacle cavity induces the desired oxygen "bloom" in a fresh meat food product, and in other food products replaces the inert gas atmosphere in preparation for display and consumption of the food product. The final configuration of the package as displayed to consumers has the same external appearance as prior art packages, leading to ready consumer acceptance while greatly enhancing product life and reducing spoilage associated with production and distribution of the food products from a central processing facility. The invention also contemplates a package and a receptacle construction for use in carrying out the described method.

4 Claims, 2 Drawing Sheets

U.S. PATENT DOCUMENTS

| | | | |
|---|---|---|---|
| 3,512,632 | 5/1970 | Wiggins . | |
| 3,659,393 | 5/1972 | Richter . | |
| 3,735,551 | 5/1973 | Pratt . | |
| 4,055,672 | 10/1977 | Hirsch et al. . | |
| 4,162,599 | 7/1979 | Kyle . | |
| 4,409,252 | 10/1983 | Buschkens et al. . | |
| 4,581,764 | 4/1986 | Plock et al. . | |
| 4,581,874 | 4/1986 | Rechtsteiner et al. . | |
| 4,589,145 | 5/1986 | Van Erden et al. . | |
| 4,754,596 | 7/1988 | Yasumune et al. . | |
| 4,896,479 | 1/1990 | Gannon . | |
| 4,919,955 | 4/1990 | Mitchell . | |
| 5,271,207 | 12/1993 | Epstein et al. . | |
| 5,445,838 | 8/1995 | Lipinski et al. . | |
| 5,481,852 | 1/1996 | Mitchell . | |
| 5,711,978 | 1/1998 | Breen et al. . | |
| 5,759,650 | 6/1998 | Raines et al. . | |
| 5,989,613 * | 11/1999 | Buchko | 426/396 |

* cited by examiner

FIG. 1
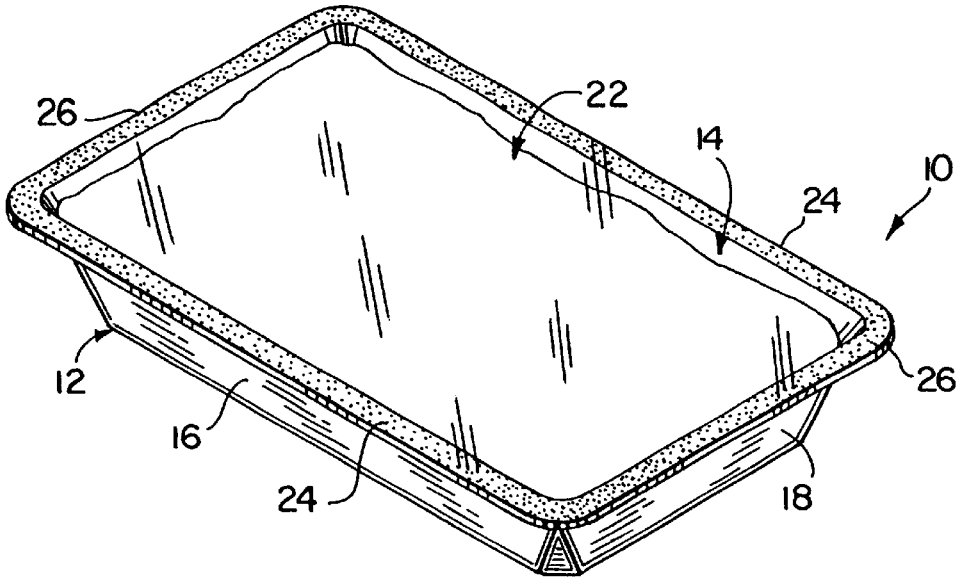
FIG. 2
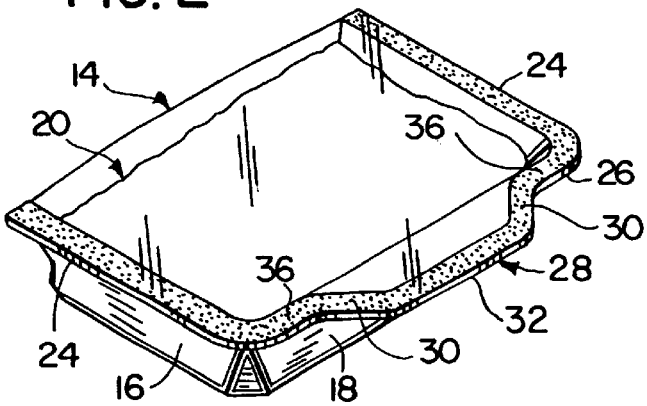
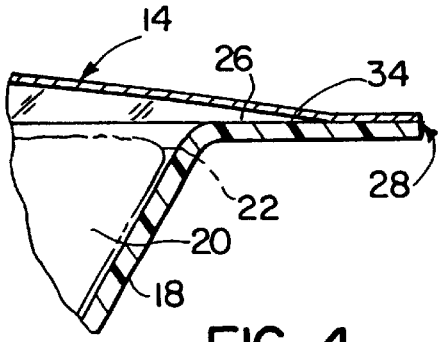
FIG. 4
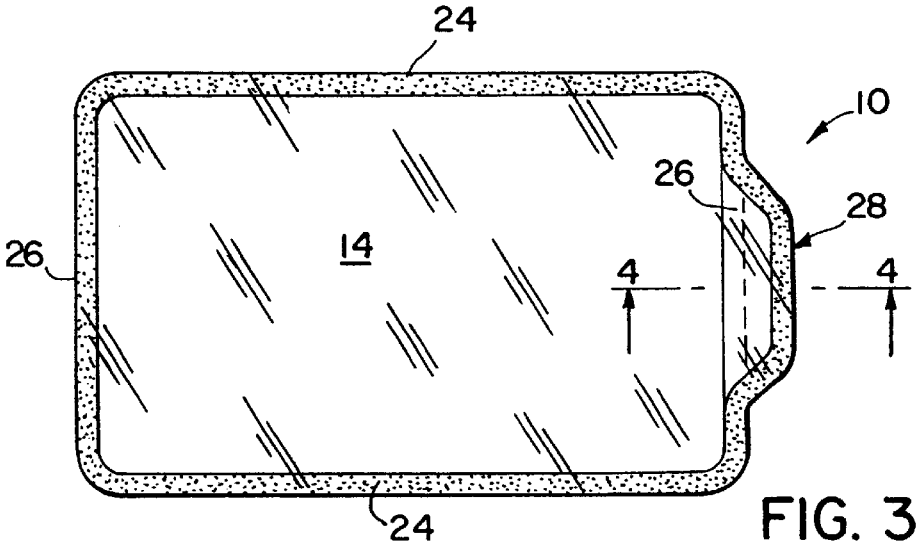
FIG. 3

TRAY-TYPE RECEPTACLE FOR USE IN A PACKAGING METHOD FOR PERISHABLE FOOD PRODUCTS

CROSS-REFERENCE TO RELATED APPLICATION

This application is a divisional of application Ser. No. 08/782,775, filed Jan. 13, 1997, U.S. Pat. No. 5,989,613.

BACKGROUND AND SUMMARY OF THE INVENTION

This invention relates to packaging, and more particularly to packaging of perishable food products.

In packaging of fresh red meat products, it is known to initially cut and package the meat products at a processing facility for subsequent shipment to retail outlets. Typically, the meat products are packaged such that ambient air is contained within the package, which can result in discoloration of the meat product caused by conversion of myoglobin meat pigment to a grayish or brownish metmyoglobin. This discoloration generally renders the meat product unacceptable for consumers. Ultimately, such exposure to ambient air can result in spoilage of the meat product.

In order to avoid discoloration and spoilage of meat products and to provide a desirable aging of the meat product, it is known to vacuum package the meat product to remove ambient air and any other atmosphere from the package. It is also known to package the meat product in an inert gas atmosphere, such as a nitrogen gas atmosphere.

Vacuum packaging of meat products is less than optimal for several reasons. First, vacuum packaging is a relatively expensive process requiring specialized equipment. Secondly, vacuum packaging produces an end product in which the film wrap material is in contact with the meat product, resulting in an irregularly shaped package which is undesirable from the standpoint of product presentation. Further, vacuum packaged meat products do not have the deep red color desired by consumers.

Packaging fresh meat products with an inert gas atmosphere has been found to be an acceptable way to preserve the meat product and provide a desirable aging, after shipment of the meat product from a processing facility to a retail outlet. However, once the package has arrived at the retail outlet, it is necessary to replace the inert gas atmosphere within the package with an oxygen-containing atmosphere. This removes any discoloration on the surface of the meat product which may have been caused by the presence of the inert gas atmosphere, and produces the desired oxygen "bloom" which results in the desirable deep red color on the surface of the meat product.

U.S. Pat. No. 4,055,672 issued Oct. 25, 1977 discloses a system in which a meat product is packaged within a package in which one of the package walls is formed from a gas impermeable material and another package wall is formed of an inner gas permeable layer and an outer gas impermeable layer. The meat product is initially packaged in an inert gas atmosphere, which is maintained within the package by the package walls including the outer gas impermeable wall layer. When it is desired to display the meat product for purchase by a consumer, the outer gas impermeable layer is removed, which enables oxygen-containing ambient air to flow into the package through the gas permeable layer. This results in the desired oxygen bloom in preparation for display. This system is disadvantageous in that deterioration of the product is not prevented after the impermeable layer has been removed, unless an additional impermeable layer is subsequently added to the package. In addition, it is necessary to add an impermeable layer over the permeable layer if the product is to be frozen. Further, the required combination of a gas impermeable film layer overlying a gas permeable film layer is difficult and expensive to produce, and difficult to seal to the container in a manner providing satisfactory removal of the gas impermeable layer.

U.S. Pat. No. 4,919,955 issued Apr. 24, 1990, discloses a packaging system in which a septum valve is incorporated into the wall of a tray in which the meat product is packaged. A hollow needle is inserted through the septum valve and is interconnected with an atmosphere exchange device, which functions to remove the inert gas atmosphere from the interior of the package and replace it with an oxygen-containing atmosphere, to induce the desired oxygen bloom in the meat product. After the atmosphere within the package is exchanged, the hollow needle is removed and the septum valve closes to maintain the oxygen-containing atmosphere within the package. Again, this system is functional to replace an inert gas atmosphere with an oxygen-containing atmosphere in the interior of a package. However, the septum valve provides a point of entry for possible tampering with the package contents while the package is on display, which would not leave any trace of tampering on the package itself. Further, the hollow needle terminates in a sharp end which could give rise to hazardous conditions for the operator of the atmosphere exchange device.

It is an object of the present invention to provide a packaging system for perishable products in which an inert gas atmosphere within the interior of the package can be easily and quickly replaced with an oxygen-containing atmosphere. It is a further object of the invention to provide such a packaging system in which the final package is identical in appearance to prior art packages from a consumer standpoint. It is a further object of the invention to provide such a packaging system in which the packaged product can be frozen without having to add an additional layer of wrap material to the package. Yet another object of the invention is to provide such a packaging system in which the atmosphere within the package interior is replaced using an oxygen-containing atmosphere delivery apparatus which does not present the potential for harm to an operator. A still further object of the invention is to provide such a packaging system in which the final package configuration is not susceptible to undetectable tampering.

In accordance with one aspect of the invention, an atmosphere exchange method is provided for a perishable food product package in which the food product is disposed within a receptacle having an internal cavity and an inert gas atmosphere is contained within the receptacle cavity, and in which a substantially impermeable film is sealed to the receptacle to maintain the inert gas atmosphere within the receptacle cavity. The atmosphere exchange method of the invention involves forming an opening in a portion of the seal between the film and the receptacle, replacing the inert gas atmosphere within the receptacle cavity, through the opening, with a non-inert gas atmosphere, and sealing the film to the receptacle to close the opening and to maintain the non-inert gas atmosphere within the receptacle cavity. The receptacle preferably includes a side wall having an upper surface including a lateral projection. The step of forming the opening in the seal between the film and the receptacle is carried out by first sealing the film to an outer portion of the lateral projection while leaving an inner portion of the lateral projection unsealed, and subsequently removing at least the outer portion of the lateral projection such that the opening is formed between the film and the inner unsealed portion of the lateral projection. The upper surface of the receptacle side wall is sealed to the film on either side of the lateral projection to define a pair of aligned spaced sealed areas, and the step of removing at least the outer portion of the lateral projection is carried out such that the opening is located between the pair of aligned, spaced sealed areas. The step of replacing the inert gas atmosphere within the receptacle cavity is carried out by separating the film from the side wall upper surface at the unsealed area to form the opening, and introducing the non-inert gas atmosphere into the receptacle cavity interiorly of the opening and simultaneously enabling the inert gas to escape the receptacle cavity through the opening. The step of introducing the non-inert gas atmosphere into the receptacle cavity is carried out utilizing a nozzle having a discharge area, and inserting the nozzle through the opening such that the nozzle discharge area is disposed interiorly of the opening and in communication with the receptacle cavity. The nozzle occupies less than the entire area of the opening, such that the unoccupied portion of the opening creates an outlet passage establishing communication between the receptacle cavity and the exterior of the receptacle for allowing the inert gas atmosphere to escape from the package interior upon introduction of the inert gas atmosphere. The step of separating the film from the side wall upper surface at the unsealed area is carried out by stretching the film between the spaced sealed areas to allow the nozzle to pass through the opening. The film at the unsealed area then returns to its original, unstretched condition subsequent to removal of the nozzle, and the step of sealing the film to the receptacle to close the opening is carried out by sealing the film to the receptacle at the previously unsealed area between the sealed areas. With this arrangement, the atmosphere within the package is exchanged and the package has the external appearance of any conventional fresh meat product packaged within a tray-type receptacle having an impermeable film overwrap sealed thereto.

In accordance with another aspect of the invention, a package for use in packaging a perishable food product is in the form of a receptacle defining an internal cavity and having a peripheral sealing surface, and a film sealed to the peripheral sealing surface. The receptacle includes a tab portion, and the peripheral sealing surface includes a non-linear segment in which the film is sealed to the tab portion. The receptacle further includes a sealing area located inwardly of the non-linear segment of the sealing surface and substantially coplanar with spaced portions of the sealing surface on either side of the non-linear segment. With this construction, the tab and the film secured to the non-linear segment can be removed to create an unsealed area between the film and the receptacle for use in exchanging the atmosphere within the receptacle cavity. After the atmosphere has been exchanged, the film is sealed to the sealing area to close the opening. The sealing area extends substantially linearly between the spaced portions of the sealing surface on either side of the non-linear segment. The receptacle preferably has a series of side walls extending upwardly from a bottom wall, and each side wall includes a sealing flange located at its upper end. The tab extends outwardly from the sealing flange of one of the side walls, such that the peripheral sealing surface is defined by the sealing flanges in combination with the tab. The tab is preferably in the form of a planar extension of one of the sealing flanges, and preferably has a length less than the length of the sealing flange from which it extends. The sealing flange on either side of the tab defines the spaced linear segments of the peripheral sealing surface between which the non-linear segment is located. In a preferred form, the sealing flange and the tab are configured such that removal of the tab between the spaced linear segments of the peripheral sealing surface results in a sealing flange substantially identical in configuration to a sealing flange associated with at least one other side wall of the receptacle.

In accordance with another aspect of the invention, a receptacle for use in packaging a perishable food product includes a bottom wall and a series of side walls extending upwardly therefrom to define an internal cavity for receiving the perishable food product. The upstanding side walls define a peripheral sealing surface adapted to have a film sealed thereto for closing the internal cavity. At least at first one of the side walls includes a lateral projection having an outer edge defining a portion of the sealing surface and an inner area substantially coplanar with the outer edge and with spaced portions of the sealing surface adjacent the lateral projection. The first side wall includes a sealing flange defining a portion of the peripheral sealing surface, and the lateral projection extends from the sealing flange and is substantially coplanar therewith. The first side wall and its associated sealing flange have a length greater than that of the lateral projection.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view of a perishable food product package resulting from the packaging system of the invention, incorporating a tray-type receptacle and an impermeable film secured thereto;

FIG. 2 is a partial isometric view showing the package of FIG. 1 in its original configuration showing the tab extending outwardly from the upper end of one of the receptacle side walls;

FIG. 3 is a top plan view of the package of FIG. 2 showing the receptacle in its initial configuration;

FIG. 4 is a partial section view taken along line 4—4 of FIG. 3;

DETAILED DESCRIPTION OF THE INVENTION

Figure 9:
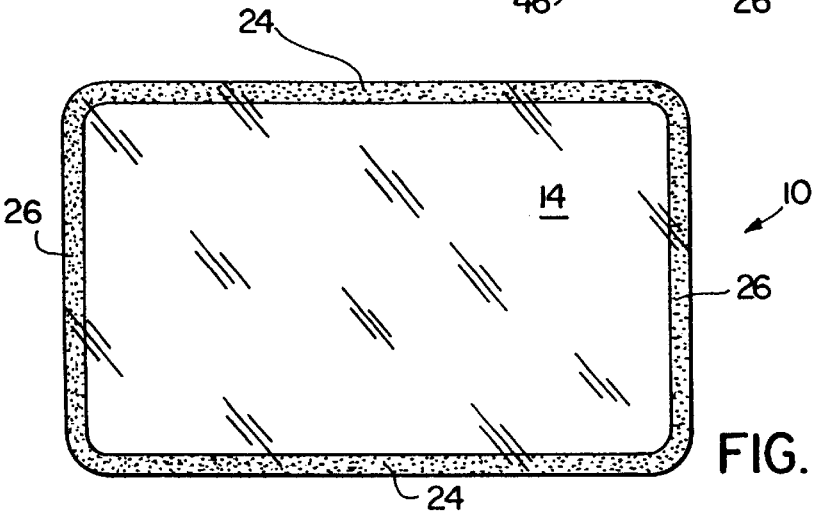
FIG. 9 is a top plan view of the package of FIG. 1 showing the end result of the method illustrated in FIGS. 5–8.

With reference to FIGS. 1 and 9, a package 10 for a perishable food product generally includes a tray-type receptacle 12 having an impermeable film 14 sealed thereto.

Receptacle 12 includes a bottom wall having a pair of spaced side walls 16 and a pair of spaced end walls 18 extending upwardly therefrom. Side walls 16 and end walls 18 are interconnected with each other and cooperate with the bottom wall of receptacle 12 to define an internal cavity 20 within which a perishable food product 22 is placed. Food product 22 may be any perishable food product subject to deterioration upon exposure to ambient air, such as meat, cheese, fruit or vegetable products. Initially, it is contemplated that the invention will be especially well suited for use with fresh red meat products initially packaged at a central processing facility and subsequently shipped to retail outlets for purchase by consumers. However, the invention is well suited for use with any other food product susceptible to discoloration or spoilage upon exposure to ambient air. Food product 22 is placed within receptacle cavity 20 in any conventional manner.

Each side wall 16 has a laterally extending sealing flange 24 at its upper end. Similarly, each end wall 18 has a laterally extending sealing flange 26 at its upper end. Sealing flanges 24, 26 are interconnected with each other to define a peripheral sealing surface to which film 14 is sealed in a conventional manner, such as by heat sealing, to maintain a desired atmosphere within receptacle cavity 20.

Package 10 as illustrated in FIGS. 1 and 9 is suitable for display at a retail establishment for purchase by a consumer. FIGS. 2–4 illustrate the original configuration of package 10, and FIGS. 5–8 illustrate the steps involved in processing package 10 to achieve the final configuration of package 10 as shown in FIGS. 1 and 9 from the original package configuration as shown in FIGS. 2–4.

Package 10 as illustrated in FIGS. 2–4 will typically be produced at a central processing facility for subsequent distribution to retail outlets. In its original configuration of FIGS. 2–4, package 10 includes a tab 28 which extends laterally outwardly from sealing flange 26 of one of end walls 18. Tab 28 is in the form of an extension of sealing flange 26 having a length less than the overall length of sealing flange 26. Tab 28 may assume any configuration, and the illustrated embodiment tab 28 is generally trapezoidal in configuration.

As shown in FIGS. 2–4, film 14 is sealed to sealing flanges 24 of side walls 16, and is also sealed to sealing flange 26 of side wall 18 on either side of tab 28. At tab 28, film 14 is sealed at a pair of angled side areas, shown at 30, and an outer end area shown at 32. Tab 28 has a width greater than the width of seal outer end area 32, and film 14 is sealed to the outer area of tab 28. An inner area of tab 28, shown in FIG. 4 at 34, is not sealed to film 14. Unsealed inner area 34 of tab 28 is located between the outer end portion of seal 32 and the portion of sealing flange 26 from which tab 28 extends. As can thus be appreciated, the seal between film 14 and receptacle 12 includes a pair of spaced end portions 36 at which film 14 is sealed to sealing flange 26, and a non-linear segment defined by angled seal side portions 30 and outer end portion 32 disposed therebetween.

The package configuration of FIGS. 2–4 provides a peripheral gas impermeable seal between receptacle 12 and film 14. Preferably, an inert gas atmosphere is contained within receptacle cavity 20 so as to retard or prevent deterioration of food product 22 subsequent to initial packaging at the central processing facility during shipment of package 10 to a retail establishment.

The steps illustrated in FIGS. 5–8 are carried out in preparation for display of package 10 at a retail establishment, such as a grocery store, meat market or the like, in order to replace the inert gas atmosphere contained within receptacle cavity 20 with an oxygen-containing atmosphere.

Figure 5:
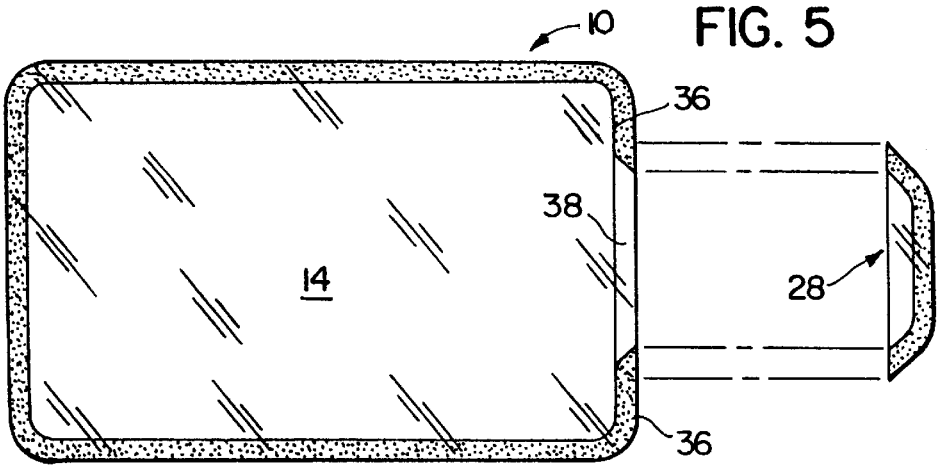
FIG. 5 is a view similar to FIG. 3, showing removal of the tab in order to form an opening between the film and the receptacle.
Figure 6:
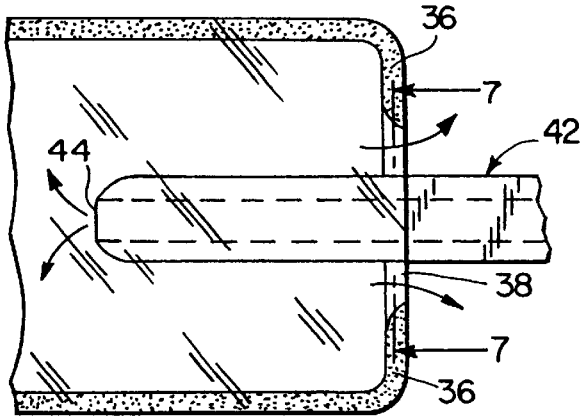
FIG. 6 is a top plan view of a portion of the package of FIG. 5, showing an atmosphere exchange nozzle inserted through the opening.

As shown in FIG. 5, tab 28 is removed from package 10 by severing tab 28 from sealing flange 26 so as to form a linear edge to sealing flange 26 identical to that of sealing flange 26 opposite the sealing flange from which tab 28 extends. The area of film 14 sealed to tab 28 and overlying unsealed area 34 is also removed at the same time tab 28 is removed. Upon removal of tab 28 and the film 14 overlying tab 28, an opening is formed between film 14 and receptacle 12. This opening is in the form of an unsealed area 38 (FIGS. 5, 7) between film 14 and sealing flange 26, which is located between the spaced seal portions 36 at which film 14 is sealed to sealing flange 26.

Figure 7:
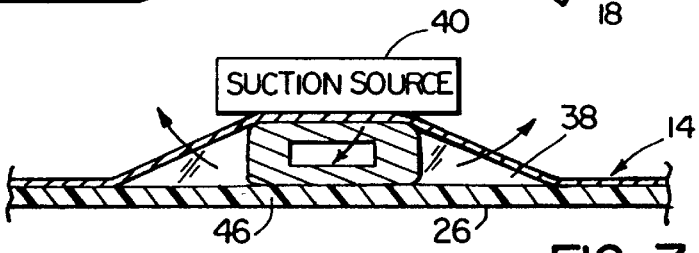
FIG. 7 is a partial section view taken along line 7—7 of FIG. 6.

Subsequent to forming opening 38 by removal of tab 28 and film 14 secured thereto, film 14 at opening 38 is lifted upwardly from sealing, flange 26 as shown at FIG. 7 utilizing a suction source 40. Film 14 is stretchable and resilient, which enables film 14 to be stretched slightly to accommodate such upward lifting movement of film 14 at opening 38. An atmosphere exchange nozzle 42 is then inserted through opening 38 such that an inner portion of nozzle 42 is disposed inwardly of opening 38 and overlying food product 22 within receptacle cavity 20. Nozzle 42 includes a discharge 44 at its outer end and a passage 46 in communication with discharge 44. After nozzle 42 is inserted through opening such that discharge 44 is disposed inwardly of opening 38, an oxygen-containing gas is supplied through passage 46 and discharged from discharge 44 into receptacle cavity 20. This discharge of oxygen-containing gas through nozzle discharge 44 functions to replace the inert gas atmosphere within receptacle cavity 20, to produce the desired oxygen bloom on the surface of a fresh red meat food product 22. While the oxygen-containing gas is being discharged into receptacle cavity 20, the inert gas atmosphere is forced out of receptacle cavity 20 through the portion of opening 38 which is unoccupied by nozzle 42. Essentially, the portion of opening 38 unoccupied by nozzle 42 forms an exhaust or discharge passage which enables the inert gas atmosphere to escape receptacle cavity 20 upon introduction of the oxygen-containing gas into receptacle cavity 20 through nozzle discharge 44.

Figure 8:
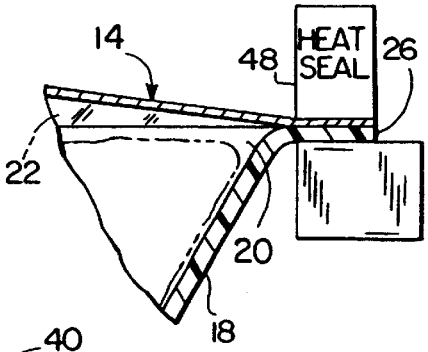
FIG. 8 is a partial section view showing resealing the opening in the package of FIG. 7 after removal of the atmosphere exchange nozzle.

After the atmosphere within receptacle cavity 20 has been exchanged, nozzle 42 is withdrawn from opening 38 and film 14 returns to its unstretched condition such that the portion of film 14 overlying opening 38 is in close proximity to the upper surface of sealing flange 26. Opening 38 is then closed by sealing film 14 to sealing flange 26, such as by utilization of a heat source 48 (FIG. 8). This closure of opening 38 forms a continuous seal of film 14 to sealing flange 26, such that the seal at opening 38 is continuous with spaced seal end portions 36. Heat source 48 is preferably configured so as to overlie the entirety of opening 38 and the ends of seal end portions 36 adjacent thereto, to ensure that a continuous air-tight seal is formed between film 14 and sealing flange 26 throughout the length of sealing flange 26.

The atmosphere exchange method of the invention has been shown and described with reference to introducing the oxygen-containing atmosphere into receptacle cavity 20 using nozzle 42. As an alternative, it is also contemplated that nozzle 42 can be eliminated and oxygen-containing air introduced into receptacle cavity 20 through opening 38 simply by blowing the oxygen-containing atmosphere into receptacle cavity 20 while film 14 is held in its position of FIG. 7 to maintain opening 38 in its open position. It is contemplated that introducing oxygen through opening 38 under pressure will introduce a sufficient amount of oxygen into receptacle cavity 28 to induce the oxygen bloom in food product 22. The pressurized stream of oxygen-containing atmosphere occupies less than the entire area of opening 38, thus enabling inert gas to escape receptacle cavity 20 while the oxygen-containing atmosphere is introduced through opening 38.

In addition, it is contemplated that, if nozzle 42 is used to introduce the oxygen-containing atmosphere into receptacle cavity 20, the length of nozzle 42 extending into receptacle cavity 20 may vary from that shown in the drawing figures. For instance, nozzle 42 may only be inserted such that its discharge 44 overlies sealing flange 26 or extends slightly past sealing flange 26 into receptacle cavity 20, thus eliminating passage of nozzle 42 over food product 22 and avoiding contact therebetween.

As shown in FIGS. 1 and 9, the final configuration of package 10 after resealing of film 14 to close opening 38 is such that the steps carried out in the atmosphere exchange process are undetectable by the consumer simply by viewing package 10 upon display. Package 10 has the same construction as prior art packages in which perishable food products such as fresh meat are typically displayed, resulting in a high degree of consumer acceptance for such products. Production and distribution of such products from a central processing facility is thus greatly facilitated without any adverse impact on the acceptability of such products from a consumer standpoint. The retail establishment operator simply carries out the steps illustrated in FIGS. 5–8, preferably by utilization of automated equipment designed to carry out such steps.

The packaging method of the invention as set forth above, and the package used in connection therewith, thus attains the objects as set forth above and provides a simple, efficient solution to shelf life, product discoloration and spoilage problems associated with distributing perishable food products from a central processing facility, and provides an effective system for preparing such products for display at a retail establishment.

The invention has been shown and described in terms of exchanging an inert gas atmosphere within a package with a non-inert gas atmosphere. However, it is understood that the invention can be used in any application in which a first atmosphere (or lack of atmosphere) within the interior of a package is exchanged or replaced with a second atmosphere.

Various alternatives and embodiments are contemplated as being within the scope of the following claims particularly pointing out and distinctly claiming the subject matter regarded as the invention.

I claim:

1. A receptacle for use in packaging a perishable food product, comprising a bottom wall and a series of side walls extending upwardly from the bottom wall to define an internal cavity for receiving the perishable food product, wherein the upstanding side walls define a peripheral sealing surface adapted to have a film sealed thereto for closing the internal cavity, and wherein at least a first one of the side walls includes a pair of spaced apart sealing surface portions and an outwardly extending lateral projection located therebetween, wherein the lateral projection has an outer sealing area located outwardly of the spaced apart sealing surface portions and an inner area located inwardly of the outer sealing area and aligned with the pair of spaced apart sealing surface portions, wherein the inner area is substantially coplanar with the outer sealing area and with the pair of spaced apart sealing surface portions.

2. The receptacle of claim 1, wherein the first side wall includes a sealing flange forming a part of the peripheral sealing surface and defining the pair of spaced apart sealing surface portions, wherein the lateral projection extends from the sealing flange and is substantially coplanar therewith.

3. The receptacle of claim 1, wherein the first side wall has a length greater than that of the lateral projection.

4. The receptacle of claim 2, wherein the pair of spaced apart sealing surface portions are aligned with each other.

* * * * *